US008317185B1

(12) United States Patent
Herrmann

(10) Patent No.: US 8,317,185 B1
(45) Date of Patent: Nov. 27, 2012

(54) METHOD AND APPARATUS FOR FEEDING MEDIA SHEETS IN AN IMAGE PRODUCTION DEVICE

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/101,630

(22) Filed: May 5, 2011

(51) Int. Cl.
*B65H 3/14* (2006.01)

(52) U.S. Cl. ..... 271/98; 271/105

(58) Field of Classification Search ..... 271/90, 271/97, 98, 105
See application file for complete search history.

(56) References Cited

U.S. PATENT DOCUMENTS

| | | | | |
|---|---|---|---|---|
| 5,470,420 | A | 11/1995 | Yokajty | |
| 5,472,543 | A | 12/1995 | Yokajity | |
| 6,279,896 | B1 * | 8/2001 | Linder et al. | 271/98 |
| 6,398,208 | B1 * | 6/2002 | Yang et al. | 271/107 |
| 6,554,269 | B1 | 4/2003 | Dobbertin et al. | |
| 6,634,635 | B2 * | 10/2003 | Kaya et al. | 271/97 |
| 7,007,944 | B1 | 3/2006 | Dobbertin et al. | |
| 7,222,846 | B2 * | 5/2007 | Horiuchi | 271/98 |
| 2001/0017441 | A1 * | 8/2001 | Yamaguchi et al. | 271/94 |
| 2002/0105133 | A1 * | 8/2002 | Jensen | 271/97 |
| 2003/0230843 | A1 * | 12/2003 | Clark | 271/90 |
| 2004/0041328 | A1 * | 3/2004 | DiNatale et al. | 271/97 |
| 2006/0267264 | A1 * | 11/2006 | Takai et al. | 271/98 |

OTHER PUBLICATIONS

Douglas K. Herrmann; "Method and Apparatus for Feeding Media Sheets in an Image Production Device"; U.S. Appl. No. 13/026,400, filed Feb. 14, 2011.

* cited by examiner

*Primary Examiner* — Jeremy R Severson
(74) *Attorney, Agent, or Firm* — Ronald E. Prass, Jr.; Prass LLP

(57) ABSTRACT

A method and apparatus for feeding media sheets in an image production device is disclosed. The method may include applying a downward airflow to a top of a leading edge of a media sheet located at a top of a media stack that is to be fed to an image production section of the image production device, and applying a vacuum airflow to the top of the leading edge of the media sheet located at the top of the media stack that is to be fed to the image production section of the image production device, the applied downward airflow and the applied vacuum airflow causing the top media sheet to separate from the media stack, and feeding the separated top media sheet to the image production section.

27 Claims, 6 Drawing Sheets

METHOD AND APPARATUS FOR FEEDING MEDIA SHEETS IN AN IMAGE PRODUCTION DEVICE

BACKGROUND

Disclosed herein is a method for method and apparatus for feeding media sheets in an image production device, as well as corresponding apparatus and computer-readable medium.

In image production devices where sheets are fed from a media stack, it is important to attain consistent separation of the top media sheet from the rest of the media stack, especially media sheets of larger length. This is especially important in vacuum corrugation feeding due to the lower acquisition forces available.

If the top media sheet is not fully separated due to edge welds (sheets sticking together at the edges from the shearing operation at the mill), or other contact issues caused by ambient conditions and interactions with the paper coatings, the feed head may not acquire the sheet properly and this may lead to several failure conditions. These issues generally result in multi-feeds, such as when 2 or more media sheets are acquired and fed as a single media sheet, or mis-feeds, such as when a media sheet is not acquired within the necessary time to match the system pitch timing.

In an attempt to separate the top media sheets at the leading edge of the media stack conventional image production devices use "fluffers" to force air into the media stack. The theory of fluffing up the lead edge of the stack is based on the idea that when the top media sheet is being acquired by the feed head the resistance at the lead edge of the media sheet can be reduced by forcing air into the lead edge of the media stack.

However, the air being forced into the media stack cannot be directed accurately enough to always separate the top media sheet. The fluffer forces air to a subset of media sheets at the top of the media stack and does not always focus on the separation of the top media sheet.

SUMMARY

A method and apparatus for feeding media sheets in an image production device is disclosed. The method may include applying a downward airflow to a top of a leading edge of a media sheet located at a top of a media stack that is to be fed to an image production section of the image production device, and applying a vacuum airflow to the top of the leading edge of the media sheet located at the top of the media stack that is to be fed to the image production section of the image production device, the applied downward airflow and the applied vacuum airflow causing the top media sheet to separate from the media stack and be acquired to the feed head for feeding the separated top media sheet to the image production section.

DETAILED DESCRIPTION

Figure 1:
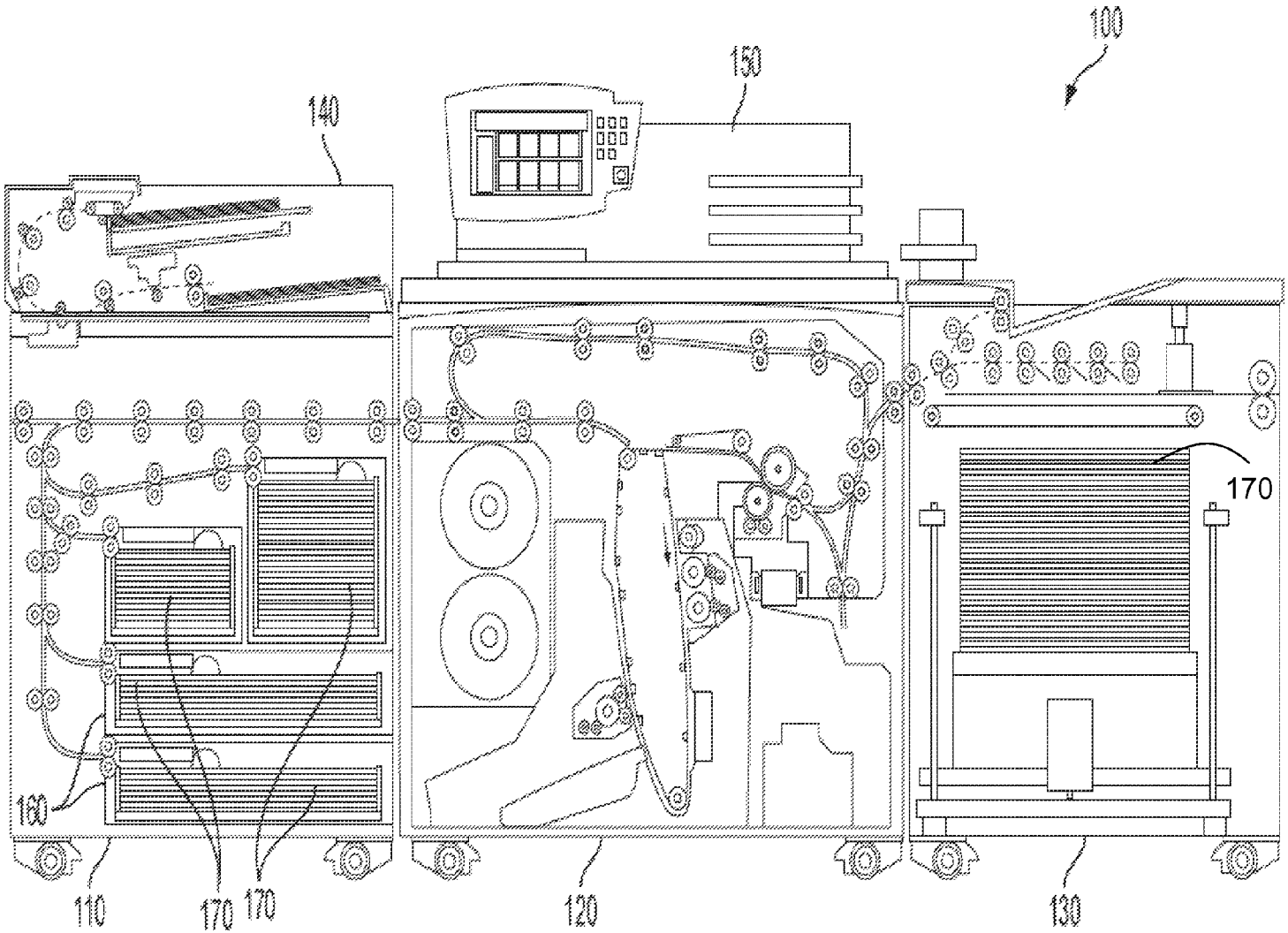
FIG. 1 is an exemplary diagram of an image production device in accordance with one possible embodiment of the disclosure.

Aspects of the embodiments disclosed herein relate to a method for feeding media sheets in an image production device, as well as corresponding apparatus.

The disclosed embodiments may include a method for feeding media sheets in an image production device. The method may include applying a downward airflow to a top of a leading edge of a media sheet located at a top of a media stack that is to be fed to an image production section of the image production device, and applying a vacuum airflow to the top of the leading edge of the media sheet located at the top of the media stack that is to be fed to the image production section of the image production device, the applied downward airflow and the applied vacuum airflow causing the top media sheet to separate from the media stack, and feeding the separated top media sheet to the image production section.

The disclosed embodiments may further include an image production device that may include a sheet separation unit that applies a downward airflow to a top of a leading edge of a media sheet located at a top of a media stack that is to be fed to an image production section of the image production device, and applies a vacuum airflow to the top of the leading edge of the media sheet located at the top of the media stack that is to be fed to the image production section of the image production device, the applied downward airflow and the applied vacuum airflow causing the top media sheet to separate from the media stack, and a feeder section that feeds the separated top media sheet to the image production section.

The disclosed embodiments may further include a feeder section of an image production device that may include a sheet separation unit that applies air downward to a top of a leading edge of a media sheet located at a top of a media stack that is to be fed to an image production section of the image production device, the applied air causing the top media sheet to separate from the media stack, and a vacuum corrugated feed head that feeds the separated top media sheet to the image production section.

The disclosed embodiments may concern feeding media sheets in an image production device. The disclosed embodiments concern a method and apparatus that may take advantage of the Bernoulli effect by forcing high velocity air across the top of a media sheet to lift the top media sheet by using the pressure differential caused by the air moving over the media sheet surface. The disclosed embodiments may ensure that lift is applied to the top media sheet.

By forcing the air down through a series of holes in the bottom plate of the vacuum corrugation feed head, the airflow may then create a high speed boundary layer between the plate and the top sheet in the stack. The airflow being applied down at the paper may then cause the paper to be "acquired" quickly and consistently. Using this in combination with the negative vacuum ports located in the feed head, may allow for quick and consistent acquisition while maintaining the vacuum force required to control the sheet during the shuttle operation to the Take Away Roll (TAR) nip.

By using the Bernoulli effect for fast and accurate acquisition of the top sheet and the vacuum ports for additional acquisition and for positive control of that acquired sheet, the combination of the these effects within the vacuum feed head may provide a novel platform for a vacuum corrugation feed head technology that does not require fluffing or the use of a critically controlled air knife.

In this manner, the disclosed embodiments may provide:

Integral Vacuum and Positive Input Bernoulli Effect Corrugation Feed Head System that uses pressure differential caused by high velocity air to lift top sheet of stack at the leading edge for top sheet media feed systems to separate and positively acquire top sheet.

Use of boundary layer of air across bottom surface of the corrugation feed head in combination with vacuum pressure to improve sheet acquisition.

Application of high velocity air directed down onto top sheet so that the high velocity air is directed between the corrugated feed head and the top sheet to create lift and improve acquisition to the vacuum corrugation feed head.

Benefits of the disclosed embodiments may include:

Improves acquisition of top sheet while reducing the multi-feeds and mis-feeds caused by current side directed fluffer and air knife designs. (Current fluffer/air knife designs can cause feed issues when different sheet weights are fed. If the fluffer is too high the heavy weight sheets are not lifted consistently causing mis-feeds. If the fluffer is too low, light weight sheets are forced up in sets and multi-feeds are caused)

Reduces the forced fluffing issues described above which cause multi-feeds and mis-feeds during acquisition.

FIG. 1 is an exemplary diagram of an image production device 100 in accordance with one possible embodiment of the disclosure. The image production device 100 may be any device or combination of devices that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the image production device 100 is also operable as a copier, the image production device 100 may further include a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the section may include any number of feeder trays 160, each of which stores a media stack 170 or print sheets ("media") of a predetermined type (size, weight, color, coating, transparency, etc.) and may include a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media may be advantageously drawn from a media stack 170 by the use of an application of heat, such as by a stream of hot air (not shown in the Figure). Sheets of media drawn from a media stack 170 on a selected feeder tray 160 may then be moved to the image production section 120 to receive one or more images thereon. Then, the printed sheet is then moved to output section 130, where it may be collated, stapled, folded, punched, etc., with other media sheets in manners familiar in the art.

Note that the image production device 100 may be or may include a stand-alone feeder section 110 (or module) and/or a stand-alone output (finishing) section 130 (or module within the spirit and scope of the disclosed embodiments.

Figure 2:
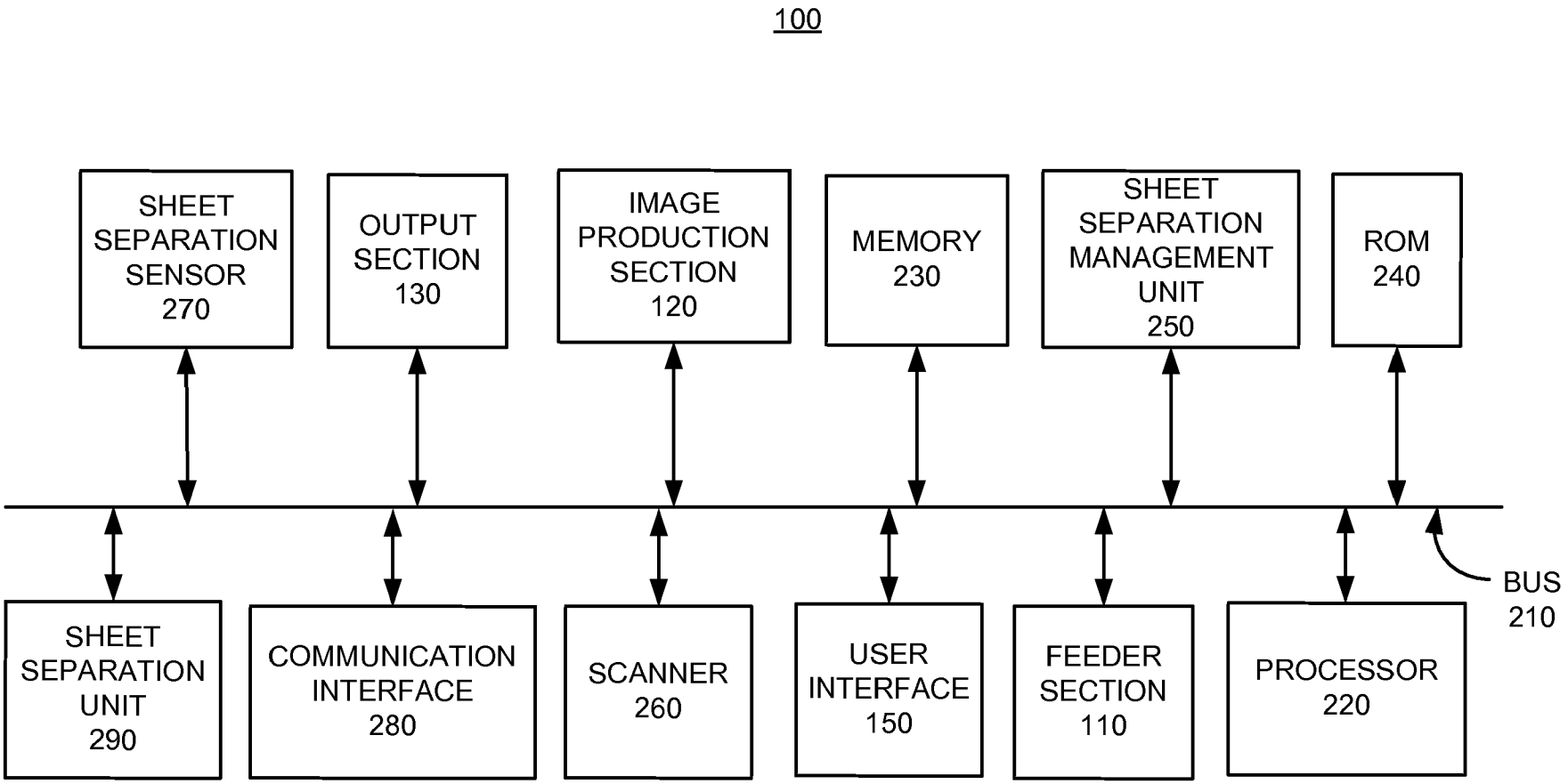
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a sheet separation management unit 250, a feeder section 110, an output section 130, a user interface 150, a scanner 260, a sheet separation sensor 270, a communication interface 280, an image production section 120, and a sheet separation unit 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example. The scanner 260 may be any device that may scan documents and may create electronic images from the scanned document. The scanner 260 may also scan, recognize, and decode marking-readable codes or markings, for example.

The sheet separation sensor 270 may be a contact image sensor (CIS), or a two-dimensional (2D) sensor array, a timing sensor, a contact sensor, etc., for example. In this manner, the sheet separation sensor 270 may serve a function of determining if the top media sheet from the media stack 170 has been acquired by one or more feed heads in the feeder section 110 and fed to the image production section 120.

In one possible embodiment, the sheet separation sensor 270 may sense whether the top media sheet has been acquired by the image production section 120. If the sheet separation sensor 270 senses that the top media sheet has not been acquired by the image production section 120, the sheet separation management unit 250 may adjust the amount of air applied to the top media sheet.

In yet another possible embodiment, the sheet separation sensor 270 may sense whether the top media sheet has been acquired by the image production section 120 within a predetermined time period. If the sheet separation sensor 270 senses that the top media sheet has not been acquired by the image production section 120 within a predetermined time period, the sheet separation management unit 250 may adjust the amount of air applied to the top media sheet. The predetermined time period may be 0.5-3 seconds, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The operation of the sheet separation unit 290 will be discussed in relation to the diagram in FIGS. 3-5, and the flowchart in FIG. 6.

Figure 3:
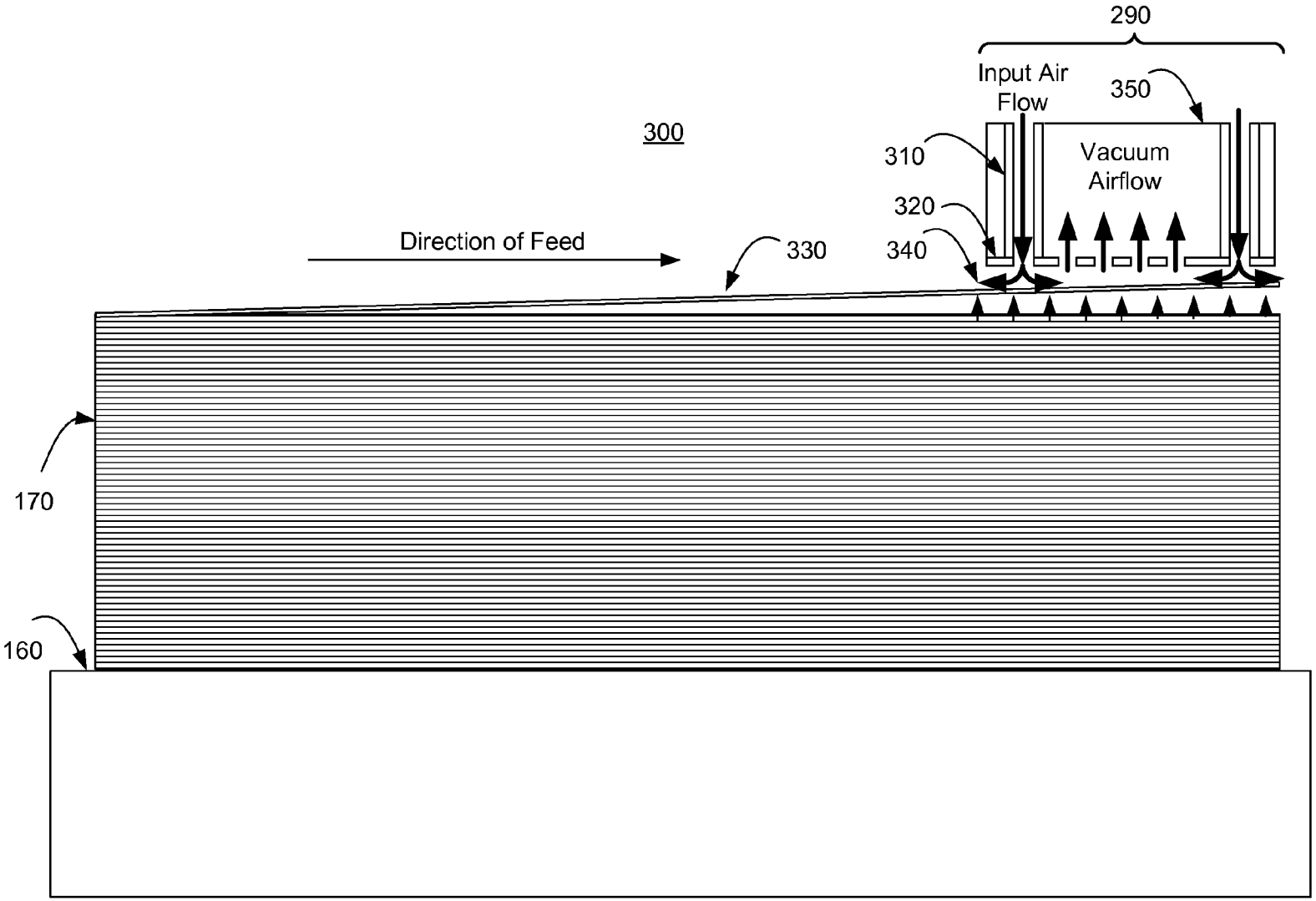
FIG. 3 is an exemplary diagram of a side view of a media sheet separation and acquisition environment in accordance with one possible embodiment of the disclosure.

FIG. 3 is an exemplary diagram of a side view of a media sheet separation environment 300 in accordance with one possible embodiment of the disclosure. The media sheet separation environment 300 may include the sheet separation unit 290, the feeder tray 160, the media stack 170, and the top media sheet 330, and. The sheet separation unit 290 may include a vacuum corrugated feed head 350, an air flow path 310 leading to one or more holes, and a plate 320. The plate 320 may have a bottom surface facing parallel to the top media sheet 330, as shown.

In operation, a downward airflow 340 may be applied from any blower known to one of skill in the art (not shown) and may travel down the air flow path 310 to one or more holes in plate 320 and is output along the surface of the top media sheet 330. As shown, the Bernoulli effect causes the leading edge of the media sheet 330 at the top of the media stack 170 to rise to enable the media sheet 330 to be properly acquired and fed by the vacuum corrugated feed head 350 of the feeder section 110 to then be acquired and processed by the image production section 120. At the same time or at a slightly later time (a delay), the vacuum corrugated feed head 350 applies a vacuum airflow to further ensure the media sheet 330 is acquired by the feeder section 110 and is sent to the image production section 120.

The vacuum airflow that may be used may range from 50-60 mm of $H_2O$ for light weight media to 120-140 mm of $H_2O$ for heavy weight media or a total range of 50 to 140 mm of $H_2O$ for all media. The positive air pressure (downward airflow 340 onto the media) may be approximately 50-70 psi but may significantly less depending on the position and/or size of valves, nozzles, channels, etc.

Note that the vacuum airflow and the downward airflow may operate such that the downward airflow begins simultaneously with the vacuum airflow, the downward airflow begins before the vacuum airflow, or the vacuum airflow begins before the downward airflow, for example. In this manner, as long as the downward airflow helps the vacuum airflow for media sheet 330 acquisition by the feeder section 110.

Figure 4:
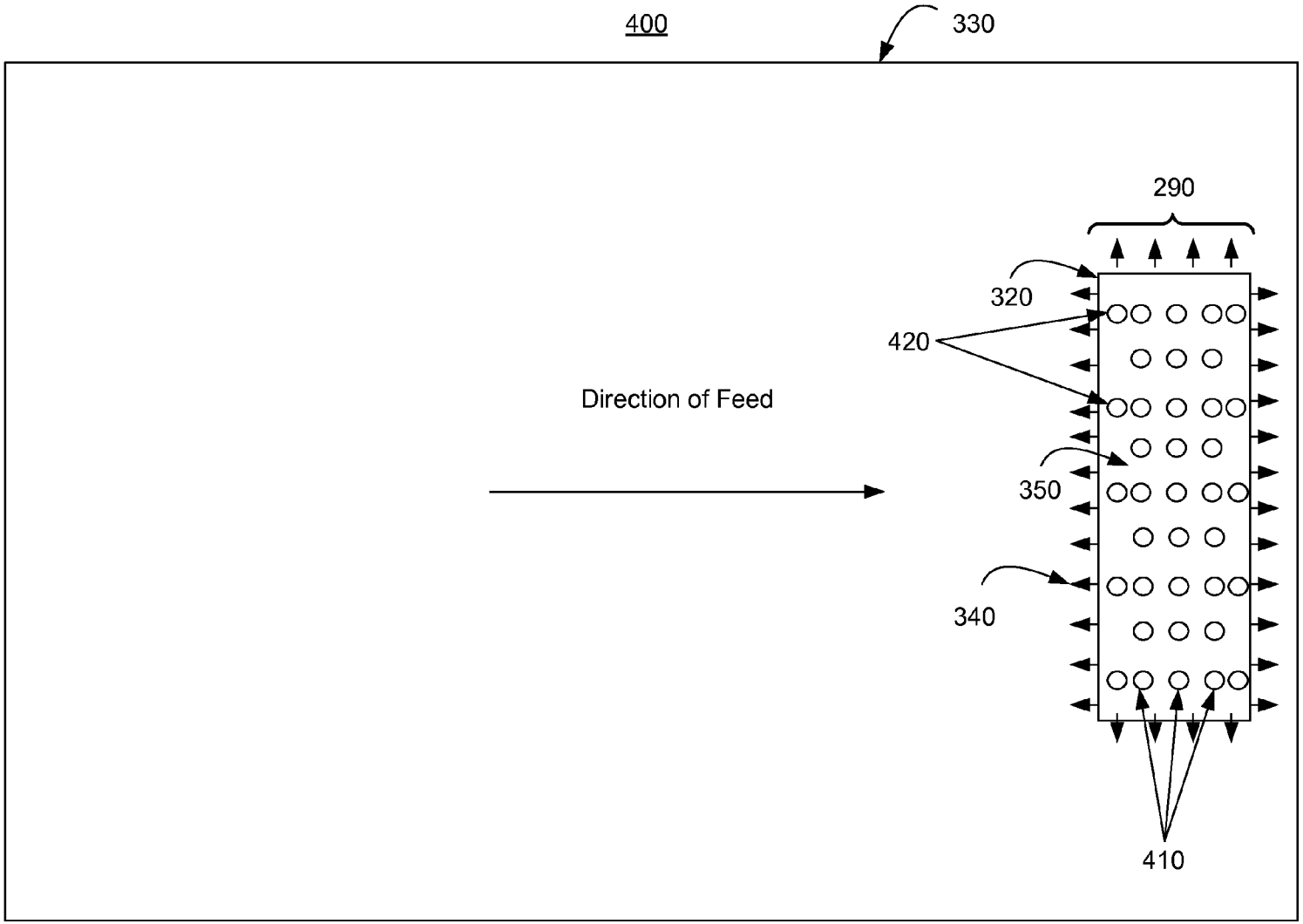
FIG. 4 is an exemplary diagram of a top view of a media sheet separation and acquisition environment in accordance with one possible embodiment of the disclosure.

FIG. 4 is an exemplary diagram of a top view of a media sheet separation environment 400 in accordance with one possible embodiment of the disclosure. The media sheet separation environment 400 may include the sheet separation unit 290, and the top media sheet 330. The sheet separation unit 290 may include a vacuum corrugated feed head 350 the may include plate 320 with a plurality of holes 410, 420. In this exemplary embodiment, the holes 420 on the periphery of the plate 320 are the holes through which downward airflow 340 is applied to the top media sheet 330. The holes 410 which are inboard of the downward airflow holes 420 are holes through which the vacuum airflow is applied. The holes 410, 420 may be arranged in any fashion, such as in rows as in the figure, for example. While the downward airflow holes 420 are shown on the periphery of the plate 320 and vacuum airflow holes 410 are shown inboard of the downward airflow holes 420, any arrangement of holes 410,420 may be used within the spirit and scope of the disclosed embodiments. In addition, while the holes 410, 420 are shown to be the same size, the vacuum airflow holes 410 may be of different size than the downward airflow holes 420, and moreover, one or more vacuum airflow holes 410 and one or more downward airflow holes 420 may be different sizes than other vacuum airflow holes 410 and other downward airflow holes 420, for example.

In one particular embodiment, the one or more holes 410 may be 4 mm-10 mm in diameter, for example. The airflow may be applied approximately 25 mm to 75 mm horizontally from the leading edge of the top media sheet 330, for example.

Figure 5:
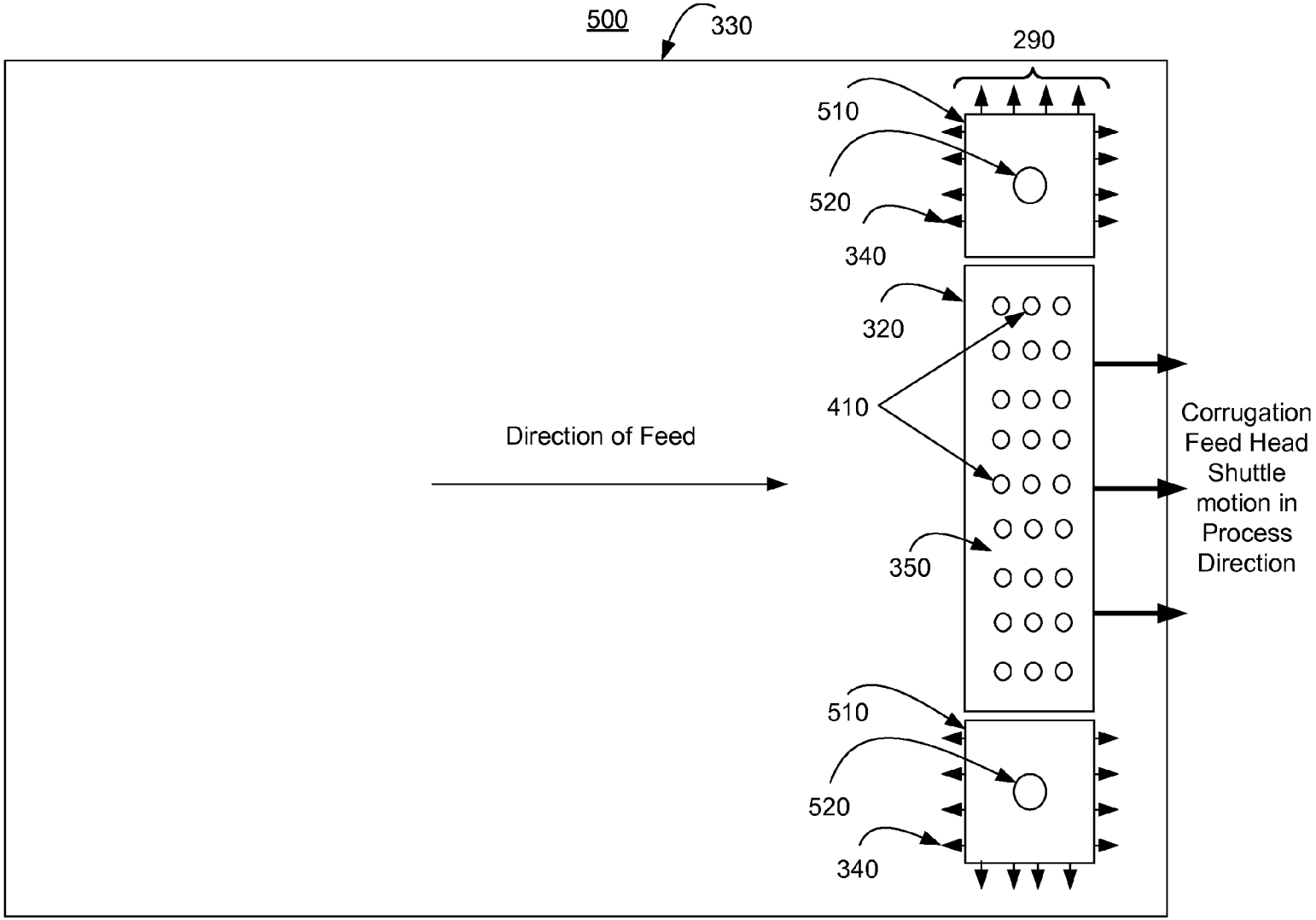
FIG. 5 is an alternative exemplary diagram of a top view of a media sheet separation and acquisition environment in accordance with one possible embodiment of the disclosure.

FIG. 5 is an alternative exemplary diagram of a top view of a media sheet separation environment 500 in accordance with one possible embodiment of the disclosure. The media sheet separation environment 500 may include the sheet separation unit 290, and the top media sheet 330. The sheet separation unit 290 may include the vacuum corrugated feed head 350 having the plate 320 which includes a plurality of vacuum airflow holes 410 through which a vacuum airflow is applied to the top media sheet 330.

Adjacent to the vacuum corrugated feed head 350, may be two downward airflow plates 510 located on each end of the vacuum corrugated feed head 350 in a longitudinal direction perpendicular to the direction to which the media sheet 330 is being fed. While this embodiment shows a particular arrangement of the vacuum corrugated feed head 350 and the two downward airflow plates 510, one of skill in the art may appreciate that any arrangement of the vacuum corrugated feed head 350 and one or more downward airflow plates 510 may be used within the spirit and scope of the disclosed embodiments. In addition, while two downward airflow plates 510 are shown, there may be any number of downward airflow plates 510 within the spirit and scope of the disclosed embodiments as long as the effect of lifting the top media sheet 330 for feeding to the feeder section 110 is performed. Moreover, while the vacuum corrugated feed head 350 is shown to move, the two downward airflow plates 510 may move with the vacuum corrugated feed head 350 or may remain stationary, for example.

The downward airflow plates 510 may include one or more downward airflow hole 520 from which a downward airflow 340 may be applied across the surface of the media sheet 330. As discussed above, the Bernoulli effect from the downward airflow 340 may cause the leading edge of the media sheet 330 at the top of the media stack 170 to rise to enable the media sheet 330 to be properly acquired and fed by the vacuum corrugated feed head 350 of the feeder section 110 to then be acquired and processed by the image production section 120.

Figure 6:
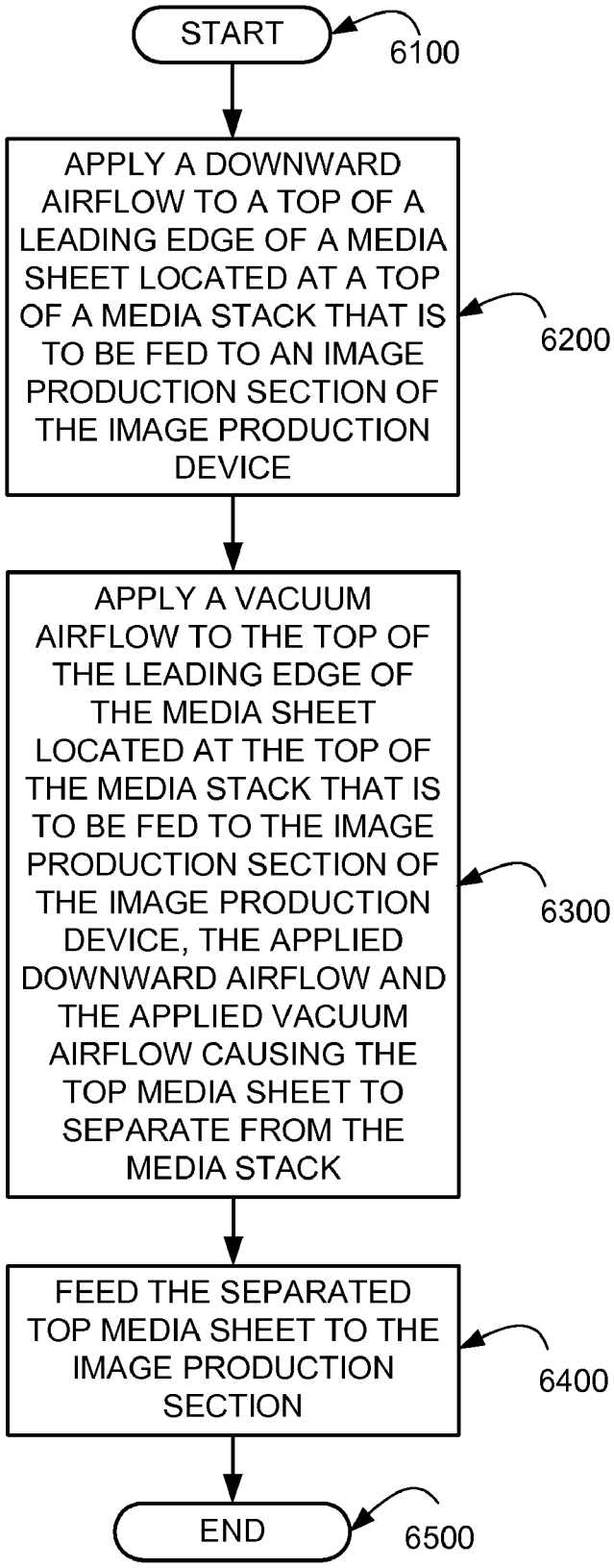
FIG. 6 is a flowchart of an exemplary media sheet feeding process in accordance with one possible embodiment of the disclosure.

FIG. 6 is a flowchart of an exemplary media sheet feeding process in accordance with one possible embodiment of the disclosure. The method may begin at step 6100, and may continue to step 6200, where the sheet separation unit 290 may apply a downward airflow to a top of a leading edge of a media sheet 330 located at a top of a media stack 170 that is to be fed to an image production section 120 of the image production device 100. Note that the leading edge of the media sheet 330 may be the edge closest to a direction that the media sheet 330 is to be fed to the feeder section 110 of the image production device.

At step 6300, the sheet separation unit 290 may apply a vacuum airflow to the top of the leading edge of the media sheet 330 located at the top of the media stack 170 that is to be fed to the image production section 120 of the image production device 100. The applied downward airflow and the applied vacuum airflow may cause the top media sheet 330 to separate from the media stack 170. At step 6400, the feeder section 110 feeds the separated top media sheet 330 to the image production section 120. The process may then go to step 6500 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for feeding media sheets in an image production device, comprising:

applying a downward airflow to a top of a leading edge of a media sheet located at a top of a media stack that is to be fed to an image production section of the image production device;

applying a vacuum airflow to the top of the leading edge of the media sheet located at the top of the media stack that is to be fed to the image production section of the image production device, the applied downward airflow and the applied vacuum airflow causing the top media sheet to separate from the media stack; and feeding the separated top media sheet to the image production section, wherein the downward airflow and vacuum airflow are applied through a sheet separation unit having a plate having a plurality of holes, the plate having a bottom surface facing parallel to the top media sheet, wherein the downward airflow is applied using a first set of holes and the vacuum airflow is applied using a second set of holes.

2. The method of claim 1, wherein the downward airflow and vacuum airflow are being applied approximately 25 mm to 75 mm horizontally from the leading edge of the top media sheet.

3. The method of claim 1, wherein the one or more holes are approximately 4 mm-10 mm in diameter.

4. The method of claim 1, wherein the first set of holes are located on the periphery of the plate and the second set of holes are located inboard of the first set of holes.

5. The method of claim 1, wherein the sheet separation unit comprises a vacuum corrugated feed head and two downward airflow plates, wherein one of the two downward airflow plates is located on each side of the vacuum corrugated feed head in a direction perpendicular to the direction that the media sheet is being fed.

6. The method of claim 1, further comprising:

sensing whether the top media sheet has been acquired by the image production section, wherein if it is sensed that the top media sheet has not been acquired by the image production section, adjusting at least one of an amount of downward airflow applied and an amount of vacuum airflow applied to the top media sheet.

7. The method of claim 1, further comprising:

sensing whether the top media sheet has been acquired by the image production section within a predetermined time period, wherein if it is sensed that the top media sheet has not been acquired by the image production section within the predetermined time period, adjusting at least one of an amount of downward airflow applied and an amount of vacuum airflow applied to the top media sheet.

8. The method of claim 1, wherein the image production device is one of a copier, a printer, a facsimile device, and a multi-function device.

9. The method of claim 1, wherein the vacuum airflow and the downward airflow operate where one of the downward airflow begins simultaneously with the vacuum airflow, the downward airflow begins before the vacuum airflow, and the vacuum airflow begins before the downward airflow.

10. An image production device, comprising:

a sheet separation unit that applies a downward airflow to a top of a leading edge of a media sheet located at a top of a media stack that is to be fed to an image production section of the image production device, and applies a vacuum airflow to the top of the leading edge of the media sheet located at the top of the media stack that is to be fed to the image production section of the image production device, the applied downward airflow and the applied vacuum airflow causing the top media sheet to separate from the media stack; and a feeder section that feeds the separated top media sheet to the image production section, wherein the sheet separation unit comprises:

a plate having a bottom surface facing parallel to the top media sheet and a having a plurality of holes, wherein the downward airflow is applied using a first set of holes and the vacuum airflow is applied using a second set of holes.

11. The image production device of claim 10, wherein the sheet separation unit applies air approximately 25 mm to 75 mm horizontally from the leading edge of the top media sheet.

12. The image production device of claim 10, wherein the one or more holes are approximately 4 mm-10 mm in diameter.

13. The image production device of claim 10, wherein the first set of holes are located on the periphery of the plate and the second set of holes are located inboard of the first set of holes.

14. The image production device of claim 10, wherein the sheet separation unit comprises a vacuum corrugated feed head and two downward airflow plates, wherein one of the two downward airflow plates is located on each side of the vacuum corrugated feed head in a direction perpendicular to the direction that the media sheet is being fed.

15. The image production device of claim 10, further comprising:

a sheet separation management unit; and a sheet separation sensor that senses whether the top media sheet has been acquired by the image production section, wherein if the sheet separation sensor senses that the top media sheet has not been acquired by the image production section, the sheet separation management unit adjusts at least one of an amount of downward airflow applied and an amount of vacuum airflow applied to the top media sheet.

16. The image production device of claim 10, further comprising:

a sheet separation management unit; and a sheet separation sensor that senses whether the top media sheet has been acquired by the image production section within a predetermined time period, wherein if the sheet separation sensor senses that the top media sheet has not been acquired by the image production section within the predetermined time period, the sheet separation management unit adjusts at least one of an amount of downward airflow applied and an amount of vacuum airflow applied to the top media sheet.

17. The image production device of claim 10, wherein the image production device is one of a copier, a printer, a facsimile device, and a multi-function device.

18. The image production device of claim 10, wherein the vacuum airflow and the downward airflow operate where one of the downward airflow begins simultaneously with the vacuum airflow, the downward airflow begins before the vacuum airflow, and the vacuum airflow begins before the downward airflow.

19. A feeder section of an image production device, comprising:

a sheet separation unit that applies air downward to a top of a leading edge of a media sheet located at a top of a media stack that is to be fed to an image production section of the image production device, the applied air causing the top media sheet to separate from the media stack; and a vacuum corrugated feed head that feeds the separated top media sheet to the image production section, wherein the sheet separation unit comprises:

a plate having a bottom surface facing parallel to the top media sheet and a having a plurality of holes, wherein the downward airflow is applied using a first set of holes and the vacuum airflow is applied using a second set of holes.

20. The feeder section of claim 19, wherein the sheet separation unit applies air approximately 25 mm to 75 mm horizontally from the leading edge of the top media sheet.

21. The feeder section of claim 19, wherein the one or more holes are approximately 4 mm-10 mm in diameter.

22. The feeder section of claim 19, wherein the first set of holes are located on the periphery of the plate and the second set of holes are located inboard of the first set of holes.

23. The feeder section of claim 19, wherein the sheet separation unit comprises the vacuum corrugated feed head and two downward airflow plates, wherein one of the two downward airflow plates is located on each side of the vacuum corrugated feed head in a direction perpendicular to the direction that the media sheet is being fed.

24. The feeder section of claim 19, further comprising:

a sheet separation management unit; and a sheet separation sensor that senses whether the top media sheet has been acquired by the image production section, wherein if the sheet separation sensor senses that the top media sheet has not been acquired by the image production section, the sheet separation management unit at least one of an amount of downward airflow applied and an amount of vacuum airflow applied to the top media sheet.

25. The feeder section of claim 19, further comprising:

a sheet separation management unit; and a sheet separation sensor that senses whether the top media sheet has been acquired by the image production section within a predetermined time period, wherein if the sheet separation sensor senses that the top media sheet has not been acquired by the image production section within the predetermined time period, the sheet separation management unit adjusts at least one of an amount of downward airflow applied and an amount of vacuum airflow applied to the top media sheet.

26. The feeder section of claim 19, wherein the image production device is one of a copier, a printer, a facsimile device, and a multi-function device.

27. The feeder section of claim 19, wherein the vacuum airflow and the downward airflow operate where one of the downward airflow begins simultaneously with the vacuum airflow, the downward airflow begins before the vacuum airflow, and the vacuum airflow begins before the downward airflow.

* * * * *